US007879263B2

(12) United States Patent
Muller et al.

(10) Patent No.: US 7,879,263 B2
(45) Date of Patent: Feb. 1, 2011

(54) METHOD AND SOLUTION TO GROW CHARGE-TRANSFER COMPLEX SALTS

(75) Inventors: Robert Muller, Eupen (BE); Jan Genoe, Messelbroek (BE)

(73) Assignee: IMEC, Leuven (BE)

( * ) Notice: Subject to any disclaimer, the term of this patent is extended or adjusted under 35 U.S.C. 154(b) by 169 days.

(21) Appl. No.: 11/880,687

(22) Filed: Jul. 24, 2007

(65) Prior Publication Data

US 2008/0179742 A1 Jul. 31, 2008

Related U.S. Application Data

(60) Provisional application No. 60/832,774, filed on Jul. 24, 2006.

(51) Int. Cl.
*H01B 1/12* (2006.01)
*H01B 1/20* (2006.01)

(52) U.S. Cl. ..... 252/519.3; 257/1; 257/40; 257/51; 257/741; 257/774; 257/E23.161; 257/E23.011; 257/E23.067; 257/E21.585; 252/500; 428/411.1

(58) Field of Classification Search ..... 257/741, 257/E23.161, 1, 40, 51, 774, E23.011, E23.067, 257/E21.585; 252/519.3; 428/411.1
See application file for complete search history.

(56) References Cited

U.S. PATENT DOCUMENTS

2007/0194301 A1* 8/2007 Sezi et al. ..... 257/40

FOREIGN PATENT DOCUMENTS

WO WO 2005053027 A1 * 6/2005

OTHER PUBLICATIONS

Heremans et al., Nonvolatile Cu/CuTCNQ/Al memory prepared by current controlled oxidation of a Cu anode in LiTCNQ saturated acetonitrile. Applied Physics Letters 88, Jun. 12, 2006, p. 242105-1-242105-3.*

Wouters et al., Organic CuTCNQ non-volatile memories for integration in the CMOS backend-of-line: Preparation from gas/solid reaction and downscaling to an area of 0.25 μm2. Apr. 2006 (Science Direct), p. 601-605.*

O'Kane et al., New Crystalline Polymers of Ag(TCNQ) and Ag(TCNQF4) Structures and Magnetic Properties. Journal of Solid State Chemistry 152, 2000, p. 159-173.*

Haran et al., Kinetics of the electron transfer reaction in tetracyanoquinodimethan solutions studied by electron spin resonance. J. Am. Chem. Soc., 1974, 96 (15), p. 4788-4790.*

(Continued)

*Primary Examiner*—Fernando L Toledo
*Assistant Examiner*—John P Dulka
(74) *Attorney, Agent, or Firm*—McDonnell Boehnen Hulbert & Berghoff LLP

(57) ABSTRACT

The present disclosure relates to methods and solutions for growing metal charge-transfer salts on a metal surface, such as a metal layer at the bottom of a via hole. The method makes use of a solution comprising a salt additive. The temperature during growth is in the range of −100° C. to +100° C. The method allows controlled growth of the metal charge transfer salt inside via hole while limiting growth outside the via hole. The method further limits corrosion of the metallic connections at the bottom of the via hole.

6 Claims, 3 Drawing Sheets

OTHER PUBLICATIONS

Muller et al., Nonvolatile Cu/CuTCNQ/Al memory prepared by current controlled oxidation of a Cu anode in LiTCNQ saturated acetonitrile. Applied Physics Letters 88, Jun. 12, 2006, p. 242105-1-242105-3.*

Muller et al., Organic CuTCNQ non-volatile memories for integration in the CMOS backend-of-line: Preparation from gas/solid reaction and downscaling to an area of 0.25 μm2. Apr. 2006 (Science Direct), p. 601-605.*

Potember, R.S. et al., "Electrical Switching and Memory Phenomena in Cu-TCNQ Thin Films", Appl. Phys. Lett., vol. 34, No. 6, Mar. 15, 1979, pp. 405-407.

Harris, Alexander R. et al., "Voltammetric, EQCM, Spectroscopic, and Microscopic Studies on the Electrocrystallization of Semiconducting, Phase I, CuTCNQ on Carbon, Gold, and Platinum Electrodes by a Nucleation-Growth Process", J. Electrochem. Soc., vol. 152, No. 9, 2005, pp. C577-C583.

Kobayashi, Keiji et al., "Synthesis and Physico-Chemical Properties of TCNQ Compounds", J. Synt. Org. Chem (JP), vol. 46, 1998, pp. 638-653 (translated abstract).

Muller, Robert et al., "CuTCNQ Based Organic Non-Volatile Memories: Downscaling, Stress Tests, and Temperature Effect on I-V Curves", 1st International Conference on Memory Technology and Design (ICMTD), Giens (F), May 21-24, 2005, pp. 1-3.

Wolf, Stanley et al., Silicon Processing for the VLSI Era, vol. 1: Process Technology, Second Edition, Lattice Press, p. 128, Publication Date =2000.

* cited by examiner

METHOD AND SOLUTION TO GROW CHARGE-TRANSFER COMPLEX SALTS

This application claims the priority of U.S. Provisional Patent Application Ser. No. 60/832,774, Jul. 24, 2006.

BACKGROUND

The invention relates to a method and a solution for growing charge-transfer complex salts, for instance in via holes during the fabrication of switching devices.

The evolution of the market of data storage memories indicates a growing need for ever-larger capacity: from gigabytes (GB's) to hundreds of gigabytes (100 GB's) or even Terabytes. Flash memory technology has so far been able to fulfil scaling requirements, keeping a reasonable cost per bit, but it is expected that this technology will face severe scaling problems beyond the 45 nm technology node due to fundamental physical limitations.

In this context, resistive switching memories—based on a resistor element that can be programmed in a high and low conductive state—constitute replacement candidates, as their physical switching mechanisms may not degrade with scaling. Among potential resistive memory materials, some promising metallic salts of charge-transfer complexes are currently investigated such as AgTCNQ and CuTCNQ, TCNQ standing for 7,7,8,8-tetracyano-p-quinodimethane. For example, the organometallic material CuTCNQ shows nanosecond electrical resistive switching. These compounds are prepared by a spontaneous chemical reaction of a metal M with a strong electron-acceptor A, leading to the semiconducting charge-transfer salt $M^+A^-$:$M+A \rightarrow M^+A^-$ (FIG. 1). $Cu^+$ $TCNQ^-$ can be prepared by dipping a copper substrate in a solution of TCNQ in acetonitrile ($CH_3CN$) at room temperature as described by Potember et al in *Appl. Phys. Lett.* 34, 405 (1979).

The global reaction (eq. 1) called "spontaneous electrolysis" consists in the corrosion of the copper substrate by dissolved TCNQ, resulting in the formation of $Cu^+TCNQ^-$ salt which has a relatively low solubility and deposits on top of the copper as a multicrystalline layer.

$$Cu+TCNQ_{CH3CN} \rightarrow Cu^+TCNQ^- \quad \text{(eq. 1)}$$

Nitrile solvents, as for example acetonitrile, are required for this reaction because they stabilize the usually unstable $Cu^+$ cation by coordination, which will be symbolized for acetonitrile solvent by $Cu^+_{CH3CN}$.

The global equation (eq. 1) consists in two steps: a simple electron transfer (oxidation-reduction) between the copper substrate and the dissolved TCNQ (symbolized by $TCNQ_{CH3CN}$, eq. 2) generating $CU^+_{CH3CN}$ cations and $TCNQ^-_{CH3CN}$ anions, followed by (partial) co-precipitation of these two ions at the copper/solution interface as $Cu^+TCNQ^-$ crystals (eq. 3).

$$Cu+TCNQ_{CH3CN} \leftrightarrow CU^+_{CH3CN}+TCNQ^-_{CH3CN} \quad \text{(eq. 2)}$$

$$Cu^+_{CH3CN}+TCNQ^-_{CH3CN} \leftrightarrow Cu^+TCNQ^- \quad \text{(eq. 3)}$$

Both reactions in eq. 2 and eq. 3 are equilibrated (represented by the symbol '↔'), but due to the large difference in standard electrode potentials ($E^{0'}$) of the electrochemical couples the electron transfer reaction (eq. 2) is completely shifted towards the right side of the equilibrium (formation of the ions $CU^+_{CH3CN}$ and $TCNQ^-_{CH3CN}$).

The second step in the formation of $Cu^+TCNQ^-$ crystals at the copper/solution interface (eq. 3) is a precipitating reaction depending upon the local concentrations of $[CU^+_{CH3CN}]$ and $[TCNQ^-_{CH3CN}]$ (both in mol/L). Crystals of $Cu^+TCNQ^-$ are deposited at the copper surface when the product of both local concentrations is higher than the constant $K_{sp}$, called the "solubility product" (eq. 4):

$$[CU^+_{CH3CN}].[TCNQ^-_{CH3CN}]>K_{sp} \quad \text{(eq. 4)}$$

Harris et al. reported in *J. Electrochem. Soc.* (2005) 152, C577, values for $Cu^+TCNQ^-$ solubility at room temperature in pure acetonitrile (0.14±0.05 millimol/L), and in acetonitrile in presence of 0.1 mol/L n-butylammonium hexafluorophosphate salt (0.7±0.3 millimol/L). Since the concentrations $[CU^+_{CH3CN}]$ and $[TCNQ^-_{CH3CN}]$ are equal in a saturated $Cu^+TCNQ^-$ solution in pure acetonitrile, the computed solubility products at room temperature are respectively $2\cdot10^{-8}$ $mol^2/L^2$ and $4.9\cdot10^{-7}$ $mol^2/L^2$ in absence and in presence of the 0.1 mol/L n-butylammonium hexafluorophosphate salt.

Although this "spontaneous electrolysis" reaction could in principle be performed on copper metal at the bottom of via-size contact holes, corresponding samples show extensive corrosion of the copper so that often even the copper interconnection near the via hole was significantly corroded and very often even interrupted (FIG. 3).

Without being bound by theory, the difference in behavior observed for the reaction between a copper substrate and a TCNQ solution in acetonitrile upon downscaling to sizes typical of via holes can be explained by a change in diffusion regime of the $TCNQ_{CH3CN}$ when the size of the metal surface becomes small. In fact, in electrochemical measurements it appeared that the mass transfer changes from planar diffusion to non-planar diffusion when the size of the electrode is decreased (FIG. 5). During this change to non-planar diffusion the current density increases, which can be attributed to an increase of flux at the electrode-solution interface. This effect has also been observed for the diffusion limited current measured in electrochemical experiments at recessed microdisc electrodes, which are similar to the via structure described herein. Since the formation of $CU^+_{CH3CN}$ and $TCNQ^-_{CH3CN}$ proceeds also by an electron transfer reaction (this time at a copper layer and with the difference that the electrons are not originating from an external circuit but from the copper itself, a similar increase of flux upon downscaling of the electrode may be observed as in the case of an electrochemical process. The corresponding increase in flux is not only valid for the species diffusing towards the electrode (TCNQ), but also for species generated at the electrode ($TCNQ^-_{CH3CN}$ and $CU^+_{CH3CN}$). Due to the enhanced flux both species are diffusing fast away from the copper present on the bottom of the via-hole such that the kinetics of the precipitation reaction (eq. 3) becomes too slow for the deposition of crystalline $Cu^+TCNQ^-$, resulting in extensive corrosion of the Cu metal on the bottom of the via. Different methods for achieving this spontaneous chemical reaction have been described, but these methods exhibit problems for controlling the growth of charge-transfer complex salts $M^+A^-$, for instance inside small volumes such as e.g. via holes of a CMOS back end-of-line wafer with metal M at the bottom of the vias (FIG. 2).

R. Müller et al describes in communication EP-2 of the 1st International Conference on Memory Technology and Design (ICMTD), Giens (F), May 21-24, 2005, a method wherein polycrystalline layers of CuTCNQ are formed on top of a patterned metal by placing the metal M in a solution of the acceptor A in an organic solvent (e.g acetonitrile or n-butyronitrile) at room temperature or at an elevated temperature (i.e. above room temperature). This method is not suitable for the growth of the semiconducting material $M^+A^-$ inside vias since the reaction between a sub-micrometer sized metallic element M with an acceptor A in liquid organic solvents is generally difficult to control, leading to uncontrolled growth of the $M^+A^-$ salt outside the via as well as to corrosion of the metallic connections beneath the via (FIG. 3).

An alternative preparation method consists in co-evaporation of the metal M and the acceptor A (mostly in stoechiometrical amounts), giving amorphous layers of the semiconducting memory material $M^+A^-$ on the whole exposed area. With this method, the stoechiometry is difficult to control when the metal M and the acceptor A are co-evaporated, and furthermore deposition of the charge-transfer complex salt $M^+A^-$ occurs also outside the vias.

Also, $M^+A^-$ wires can be grown in 250 nm diameter vias of a Cu CMOS back end-of-line wafer via the reaction of the solid metal M (deposited or patterned on a substrate) with the acceptor A in the gaseous state. The diameter and length of sub-micrometer sized semiconductor wires, resulting of the reaction of the solid metal M with vapor of the acceptor A, are difficult to control so that some via holes are only partly filled by the memory material $M^+A^-$ and the wires are growing far outside the via. This can be an issue for a subsequent planarization step undertaken before deposition of top contacts and for reproducibility of the electrical switching characteristics (switching voltages and currents).

Vapor deposition of the acceptor A on the metal M followed by treatment with vapor of an organic solvent has been reported to lead to semiconducting layers. Preparation of the memory material $M^+A^-$ by sublimation of the acceptor A on metal M on the bottom of the via hole, followed by inducing the reaction between both reagents by treatment with an organic solvent vapor, is also problematic since first all exceeding acceptor A outside the vias has to be removed before treatment with solvent vapor in order to avoid uncontrolled growth of the $M^+A^-$ salt outside the via and second, corrosion of the metallic connections beneath the via occurs.

Finally embedding of the charge transfer materials $M^+A^-$ inside a continuous solid phase (matrix) has been reported. Examples are switching devices from an organic charge-transfer salt prepared from a TCNQ polymer and fusible mixtures for melt coatings. The use of polymer based materials or fusible mixtures are challenging on two points: filling of the vias and consecutive polishing in order to remove material between the vias. Furthermore this kind of material should, due to the presence of the matrix, exhibit lower switching currents, and also lower reading currents compared to monocrystalline memory materials.

There is therefore a need in the art for method and solutions to grow charge complex salts $M^+A^-$ in small size holes, e.g. in submicrometer diameter via holes on a CMOS BEOL wafer or a similar substrate.

SUMMARY

It is an aim of the present disclosure to describe methods and solutions to deposit metal charge-transfer salts $M^+A^-$ on metal surfaces (e.g. in vias. The methods and solutions allow controlled growth of the metal charge-transfer salt on metal surfaces, e.g. inside holes of small dimensions.

It has been unexpectedly found that a method for growing a charge-transfer complex salt $M^+A^-$ on a metal M surface achieves the above mentioned aim when said method comprises the step of contacting said metal M surface at a temperature from −100° C. to 100° C. with a solution comprising: (a) at least one organic solvent comprising at least one nitrile function, (b) at least one electron acceptor molecule A, and (c) at least one salt additive being independently selected from the group consisting of $M^+Y^-$ or $E^+A^-$, wherein $Y^-$ and $E^+$ are non-reactive counterions, $A^-$ is the anion corresponding to said acceptor molecule A, and $M^+$ is the cation corresponding to the metal M.

In another aspect, of the present disclosure, a solution for growing a charge-transfer complex salt $M^+A^-$ on a metal M surface is provided. Such a solution comprises (a) at least one organic solvent comprising at least one nitrile function, (b) at least one electron acceptor molecule A; (c) at least one co-solvent wherein said at least one electron acceptor molecule A is more soluble than said charge-transfer complex salt $M^+A^-$, and (d) at least one salt additive being independently selected from the group consisting of $M^+Y^-$ and $E^+A^-$, wherein $Y^-$ and $E^+$ are non-reactive counterions, $A^-$ is the anion corresponding to said acceptor molecule A, and $M^+$ is the cation corresponding to the metal M.

In yet a further aspect of the present disclosure, such a solution is used for growing charge-transfer complex salts $M^+A^-$ on a metal M surface, where M is a metal and A is an electron acceptor molecule.

It is an advantage of the techniques described herein that, in some embodiments, charge-transfer complex salts $M^+A^-$ can be grown in holes of sub-micrometer dimensions, such as vias. It is a further advantage of these techniques that the tendency of the charge-transfer complex salts $M^+A^-$ to grow outside the hole (e.g. via) is reduced. It is a further advantage of these techniques that extensive corrosion of the metal surface (e.g. of the metallic connections at the bottom of the via) can be avoided. These techniques further allow good stoechiometric control. It is yet another advantage of these techniques that the growth of a homogeneous layer of charge-transfer complex salts $M^+A^-$ on a metal M surface can be made possible.

As used herein and unless stated otherwise, the term "Charge transfer complex" refers to compounds of two or more molecules or atoms in which electrons are exchanged between said molecules or atoms.

As used herein and unless stated otherwise, the term "Electron acceptor" refers to an electron-deficient molecule susceptible to take part as oxidant in an oxidation-reduction process.

As used herein and unless stated otherwise, the term "via" refers to a hole also called via hole in which metal is deposited, for use as an interlayer connection between two layers of an integrated circuit.

As used herein and unless stated otherwise, the acronym "CMOS" refers to complementary metal-oxide semiconductor, i.e. to integrated circuits associating two complementary transistors (one of the N-type and one of the P-type) on the same substrate.

As used herein and unless stated otherwise, the terms "back end-of-line" (BEOL) characterize a wafer that is in the back-end-of-line (BEOL) or a wafer that is undergoing backend-of-line processing. It relates to the portion of the integrated circuit fabrication where the active components (e.g. transistors, resistors, etc.) are interconnected with wiring on the wafer. BEOL generally begins when the first layer of metal is deposited on the wafer. It includes contacts, insulator, metal levels, and bonding sites for chip-to-package connections. Dicing the wafer into individual integrated circuit chips is also a BEOL process. In "Silicon Processing for the VLSI ERA" by Stanley Wolf and Richard N. Tauber, the FEOL (front-end-of-line) is defined as the steps that begin with a starting wafer up to the first-metal contact cut, and BEOL (back-end-of-line) is defined is defined as all process steps from that point on.

DETAILED DESCRIPTION

Figure 1:
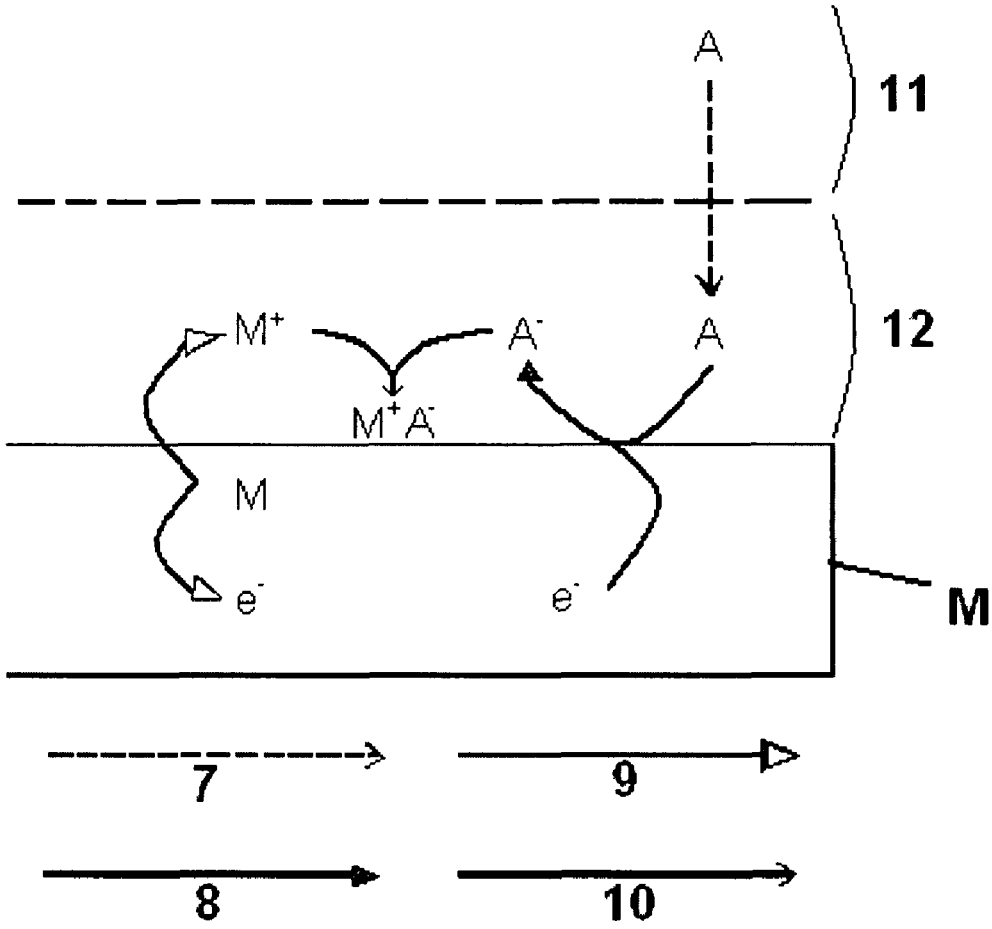
FIG. 1 (Prior Art)
FIG. 1 shows a schematic representation of the principle of the spontaneous oxidation-reduction reaction between the metal M and the acceptor A in solution according to the prior art.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Unless otherwise noted, the dimensions and the relative dimensions do not necessarily correspond to actual reductions to practice.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and that the embodiments of the invention described herein can operate in other orientations than described or illustrated herein.

The term "comprising", used in the claims, should not be interpreted as being restricted to the elements listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B.

A. A Method of Growing a Charge-Transfer Complex Salt

In a method for growing a charge-transfer complex salt $M^+A^-$ on a metal M surface, the metal M surface is contacted at a temperature ranging from about −100° C. to about 100° C. with a solution that includes at least one organic solvent comprising: (a) at least one nitrile function, (b) at least one electron acceptor molecule A, and (c) at least one salt additive, wherein the salt additive is independently selected from the group consisting of $M^+Y^-$ or $E^+A^-$ wherein $Y^-$ and $E^+$ are non-reactive counterions, $A^-$ is the anion corresponding to said acceptor molecule A and $M^+$ is the cation corresponding to the metal M.

The metal M surface may be at the bottom of a via hole in a substrate. The present method is particularly advantageous when used to fill-in via holes in a substrate because the obtained growth is sufficiently controlled to enable the filling in of hole of small dimension such as via holes without much corrosion of the metal. As an advantageous feature, the charge transfer complex salt may be grown in sub-micrometer diameter via holes.

It is preferable for the contacting temperature to range between −100° C. and 30° C. More preferably, the contacting temperature ranges between about 0° C. down to about −100° C., and most advantageously, the contacting temperature may be in the range of −10° C. to −50° C. In general, contacting temperatures below 0° C. are preferred because they permit a slower and therefore a better controlled crystal growth.

As an advantageous feature, the contacting step may comprise dipping the metal surface into the solution. The contacting step may be performed during a time period of 0.1 s to 5 min.

In one embodiment, a method is provided for growing charge-transfer complex salts $M^+A^-$ in via holes in a substrate with a metal M at the bottom, where M is a metal and A is a strongly electron-attractive acceptor molecule. In this exemplary method, at a preselected temperature, the substrate is put into a solution that includes (a) an organic solvent comprising a nitrile function, (b) strongly electron-attractive acceptor molecules A, and (c) a salt additive. The salt additive is either a metallic salt additive ($M^+Y^-$) with the same metal cation $M^+$ as in the charge-transfer complex salt $M^+A^-$, or it is a salt additive $E^+A^-$ with the same acceptor anion $A^-$ as the charge-transfer complex salt $M^+A^-$. In this embodiment, $Y^-$ and $E^+$ are unreactive counterions. A spontaneous chemical reaction is then induced of metal M with a strong electron-acceptor A, leading to the semiconducting charge-transfer salt $M^+A^-$:M+A→>$M^+A^-$.

B. A Solution for Growing a Charge-Transfer Complex Salt

The present disclosure describes a solution for use in growing a charge-transfer complex salt $M^+A^-$, such as an organic charge-transfer complex salt, on a metal M surface (e.g. in via holes comprising a metal layer at the bottom of the via). This solution comprises (a) at least one organic solvent comprising at least one nitrile function; (b) at least one electron acceptor molecule A; (c) at least one co-solvent, wherein the electron acceptor molecule A is more soluble than the charge-transfer complex salt $M^+A^-$, and (d) at least one salt additive, where each salt additive is selected from the group consisting of $M^+Y^-$ and $E^+A^-$, where and $E^+$ are non-reactive counterions, $A^-$ is the anion corresponding to the acceptor molecule A, and $M^+$ is the cation corresponding to the metal M.

The co-solvent (or co-solvents, if more than one are used together) is preferably selected from the group consisting of $C_5$-$C_{10}$ alkanes, $C_5$-$C_8$ cycloalkanes, $C_6$-$C_{15}$ aromatics, $C_5$-$C_{15}$ heteroaromatics, $C_5$-$C_{10}$ haloalkanes and $C_6$-$C_{15}$ halogenated aromatics. The use of such co-solvents is advantageous because they are inert toward the additional salt, and they help to precipitate the charge-transfer complex salt $M^+A^-$.

The organic solvent comprising at least one nitrile function can be a single organic solvent comprising a nitrile function, or it can include two or more organic solvents each comprising a nitrile function.

The metal M is preferably a monovalent metal selected from the group consisting of Cu and Ag.

As a preferred feature, the electron acceptor molecule A (or molecules, if more than one are used) may contain at least one cyano group. This is advantageous because those molecules are particularly strong electron acceptors. In particular, the electron acceptor molecule A may be selected from the group consisting of 7,7,8,8-tetracyanoquinodimethane, 2,5-dimethyl-7,7,8,8-tetracyanoquino-dimethane, 2,3,5,6-tetrafluoro-7,7,8,8-tetracyanoquinodimethane, tetracyanoethylene, and 2,3-dichloro-5,6-dicyano-p-benzoquinone. Those compounds have the advantage of being commercially available.

As an advantageous feature, the salt additive or additives may be selected from the group consisting of $Cu(CH_3CN)_4PF_6$, $Cu(CH_3CN)_4BF_4$, $Cu(CH_3CN)_4ClO_4$, $Cu(C_6H_5CN)_4PF_6$, $Cu(C_6H_5CN)_4BF_4$, $Cu(C_6H_5CN)_4ClO_4$, $AgBF_4$, $Ag(CH_3CN)_4BF_4$, $AgNO_3$, $AgSO_3CH_3$, $AgSO_3CF_3$, $AgClO_4$, $AgCO_2CH_3$, $AgCO_2CF_3$, $AgSO_3C_6H_4CH_3$, $AgCO_2C_2F_5$ and $AgCO_2C_6H_5$.

As an advantageous feature, the at least salt additive or additives may be of the general formula $E^+A^-$ wherein the anion $A^-$ is selected from the group consisting of 7,7,8,8-tetracyanoquinodimethane anion, 2,5-dimethyl-7,7,8,8-tetracyanoquinodimethane anion, 2,3,5,6-tetrafluoro-7,7,8,8-tetra-cyanoquinodimethane anion, tetracyanoethylene anion, and 2,3-dichloro-5,6-dicyano-p-benzoquinone anion.

As an advantageous feature, $E^+$ may be selected from the group consisting of $Li^+$, $Na^+$, $K^+$ and linear or branched alkylammonium cations of the general formula $(C_nH_{2n+1})_4N^+$, wherein n=1 to 10. Cations of the general formula $(C_nH_{2n+1})_4N^+$ wherein n=1 to 10 have the advantage of forming salt additives that are particularly soluble in nitrile solvents such as acetonitrile, among others.

In a particular embodiment, a solution is provided for growing a charge-transfer complex salt $Cu^+TCNQ^-$ on a Cu surface. Such a solution includes (a) at least one organic solvent comprising at least one nitrile function, (b) 7,7,8,8-tetracyanoquinodimethane, (c) at least one co-solvent wherein 7,7,8,8-tetracyanoquinodimethane is soluble and $Cu^+TCNQ^-$ is not soluble, and (d) at least one salt additive independently selected from the group consisting of $Cu^+Y^-$ and $E^+TCNQ^-$, wherein $Y^-$ and $E^+$ are non-reactive counterions.

In another embodiment, a solution is provided for growing organic charge-transfer complex salts in via holes, where the via holes comprise a metal layer at the bottom of the via. The solution comprises (a) an organic solvent comprising a nitrile function, (b) strongly electron-attractive acceptor molecules, and (c) a salt additive.

The metal at the bottom of the via hole may be a monovalent metal selected from the group consisting of Cu and Ag. The organic solvent may be a nitrile-containing solvent, such as acetonitrile.

As a preferred feature, the acceptor molecules may contain at least one nitrile group.

As an advantageous feature, when the acceptor molecules contain at least one nitrile group, the acceptor molecules may be selected from the group consisting of TCNQ, TCNQ $(Me)_2$, $TCNQF_4$, TCNE, and DDQ.

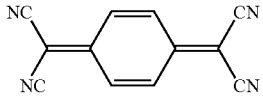

TCNQ
7,7,8,8-Tetracyanoquinodimethane
(2,5-Cyclohexadiene-1,4-diylidene)-dimalononitrile

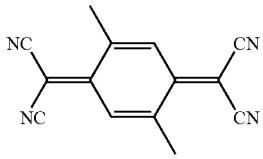

$TCNQ(Me)_2$
(2,5-Dimethyl-7,7,8,8-tetracyanoquinodimethane

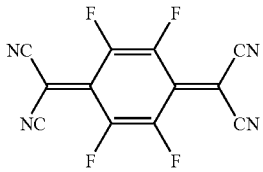

$TCNQF_4$
2,3,5,6-Tetrafluoro-7,7,8,8-tetracyanoquinodimethane
(2,3,5,6-Tetrafluoro-2,5-cyclohexadiene-1,4-diylidene)
dimalononitrile

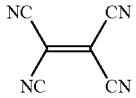

TCNE
Tetracyanoethylene
Ethylenetetracarbonitrile
Percyanoethylene

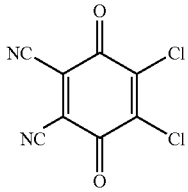

DDQ
2,3-Dichloro-5,6-dicyano-p-benzoquinone
4,5-Dichloro-3,6-dioxo-1,4-cyclohexadiene-1,2-dicarbonitrile As an advantageous feature, the salt additive may have the same metal cation as the charge-transfer complex salts and an unreactive counterion. When the salt additive has the same metal cation as the charge-transfer complex salts and an unreactive counterion, the salt additive may comprise $Cu^+$ and an unreactive counterion.

As an advantageous feature when the salt additive comprises $Cu^+$ and an unreactive counterion, the salt additive may be $Cu(CH_3CN)_4PF_6$, $Cu(CH_3CN)_4BF_4$, $Cu(CH_3CN)_4ClO_4$, $Cu(C_6H_5CN)_4PF_6$, $Cu(C_6H_5CN)_4BF_4$ or $Cu(C_6H_5CN)_4ClO_4$.

As an advantageous feature, when the salt additive has the same metal cation as the charge-transfer complex salts and an unreactive counterion, the salt additive may comprise $Ag^+$ and an unreactive counterion.

As an advantageous feature, when the salt additive comprises $Ag^+$ and an unreactive counterion, the salt additive may be $AgBF_4$, $Ag(CH_3CN)_4BF_4$, $AgNO_3$, $AgSO_3CH_3$, $AgSO_3CF_3$, $AgClO_4$, $AgCO_2CH_3$, $AgCO_2CF_3$, $AgSO_3C_6H_4CH_3$, $AgCO_2C_2F_5$, or $AgCO_2C_6H_5$, among others.

As an advantageous feature, the salt additive may comprise the same acceptor anion as the charge-transfer complex salt and an unreactive counterion. When the salt additive comprises the same acceptor anion as the charge-transfer complex salt and an unreactive counterion, the salt additive may comprise an anion selected from the group consisting of $TCNQ^-$, $TCNQF_4^-$, $TCNQ(Me)_2^-$, $DDQ^-$ and $TCNE^-$.

As an advantageous feature when the salt additive comprises an anion selected from the group consisting of $TCNQ^-$, $TCNQF_4^-$, $TCNQ(Me)_2^-$, $DDQ^-$ and $TCNE^-$, the salt additive may be $E^+A^-$ wherein $E^+$ is selected from the group consisting of $Li^+$, $Na^+$, and $K^+$, and wherein $A^-$ is selected from the group consisting of $TCNQ^-$, $TCNQF_4^-$, $TCNQ(Me)_2^-$, $DDQ^-$ and $TCNE^-$.

As an advantageous feature when the salt additive comprises an anion selected from the group consisting of $TCNQ^-$, $TCNQF_4^-$, $TCNQ(Me)_2^-$, $DDQ^-$, $TCNE^-$, etc., the salt additive may be a linear or branched alkylammonium salt with the structure $(C_nH_{2n+1})_4N^+A^-$ wherein n=1 to 10 and the anion of the acceptor $A^-$ is selected from the group consisting of $TCNQ^-$, $TCNQF_4^-$, $TCNQ(Me)_2^-$, $DDQ^-$ and $TCNE^-$.

A solution as described herein may be used in a method for growing charge-transfer complex salts $M^+A^-$ on a metal M surface, where M is a metal and A is an electron acceptor molecule.

C. A Solution for Growing a Charge-Transfer Complex Salt

The present disclosure further describes a CMOS wafer. The CMOS wafer comprises a metal layer, an insulator layer above the metal layer, and one or more via holes. These via holes extend through the insulator layer, and the bottom of the via holes is formed by portions of the metal layer. The via holes include a complex charge transfer salt $M^+A^-$ layer on top of the metal layer portions. The thickness of the portion of the metal layer on top of which the complex charge transfer salt $M^+A^-$ layer stands is in the range of 2%-10% of the thickness of the complex charge transfer salt $M^+A^-$ layer in the via hole. As one example, in the case of Cu, the theoretical thickness of the portion of the Cu layer may be 5% of the thickness of the CuTCNQ in the via.

Figure 6:
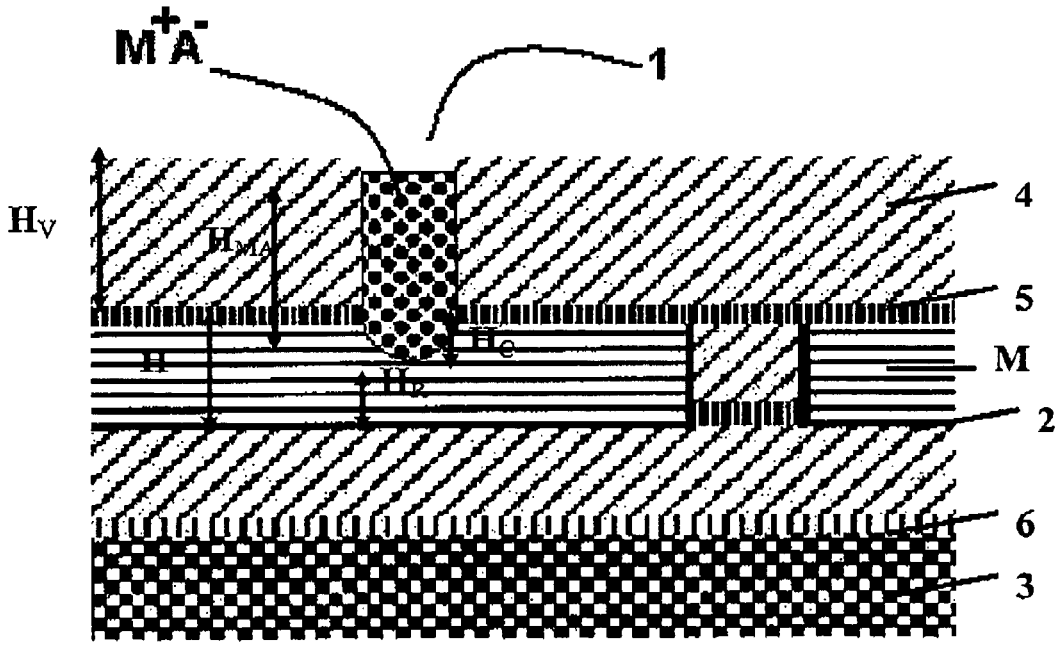
FIG. 6 shows a schematic cross section of a of solution grown metal charge-transfer complex $M^+A^-$ in via holes of a CMOS back end-of-line wafer according to the techniques described in the present disclosure.

In FIG. 6, the via hole 1 with a height is $H_V$, is filled with a complex charge transfer salt $M^+A^-$. When filling the via hole with this complex charge transfer salt $M^+A^-$, a portion of the metal layer M with thickness or height $H_c$ is consumed or corroded. This means that underneath the via hole only a thickness $H_R$ remains of the total metal M thickness $H_M$. As a result, the height of the complex charge transfer salt $M^+A^-$ has a thickness or height $H_{MA}$. The thickness or height $H_c$ that is consumed is 2%-10% of thickness $H_{MA}$ of the complex charge transfer salt $M^+A^-$ in the via. The exact percentage depends on the metal and the acceptor used. In case of Cu and TCNQ, the height $H_c$ of consumed Cu is theoretically about 5%.

It is important to maintain a sufficient level of conduction in the metal layer M underneath the via 1. Therefore the remaining metal thickness $H_R$ underneath the via should be large enough. To realise this, the total thickness $H_M$ of the metal can be chosen to be 5 times larger than the thickness $H_c$ that is consumed or corroded, even better 10 times larger, or even better 20 times larger. This means that the total thickness $H_M$ of the metal can be chosen to be ¼ of the height $H_{MA}$ of the complex charge transfer salt $M^+A^-$ in the via, even better ½ of the height $H_{MA}$.

In case the via holes are completely filled with complex charge transfer salt $M^+A^-$, the height $H_{MA}$ of the complex charge transfer salt $M^+A^-$ in the via corresponds to the via height is $H_V$, +thickness $H_c$. To have sufficient conduction in the metal layer M underneath the via 1 in case of complete filling of the via with complex charge transfer salt $M^+A^-$, the total thickness $H_M$ of the metal can be chosen to be ¼ of the via height $H_v$, even better ½ of the via height $H_v$.

As an advantageous feature, the complex charge transfer salt $M^+A^-$ layer may be homogeneous.

As an advantageous feature, the complex charge transfer salt $M^+A^-$ layer may be formed of a single crystal.

As an advantageous feature, the complex charge transfer salt $M^+A^-$ layer does not extend outside the vias.

In an exemplary embodiment, a method is provided for growing a charge-transfer complex salt $M^+A^-$ on a metal M surface. $M^+$ is the cation of the metal M and $A^-$ is the anion of an electron acceptor molecule A (e.g. a strongly electron-attractive acceptor molecule). The metal M is preferably either copper or silver, but it is not limited thereto. The electron acceptor molecule A preferably contains one nitrile group. Suitable electron acceptor molecules A include, but are not limited to 7,7,8,8-tetracyanoquinodimethane, 2,5-dimethyl-7,7,8,8-tetracyanoquinodimethane, 2,3,5,6-tetrafluoro-7,7,8,8-tetracyanoquino-dimethane, tetracyanoethylene, and 2,3-dichloro-5,6-dicyano-p-benzoquinone. Many other electron acceptor molecules can be used alternatively, such as those described by Kobayashi et al in *J. Synt. Org. Chem.* (*JP*) (1998) 46, 638.

According to one embodiment, $M^+$ may be $Cu^+$ and $A^-$ may be $TCNQ^-$. These selections therefore allow the growth of $Cu^+TCNQ^-$ on a copper surface. The charge-transfer complex salt $M^+A^-$ may be a single crystal. For instance, the charge-transfer complex salt $M^+A^-$ may be a single crystal of $Cu^+TCNQ^-$.

In certain embodiments, the methods described herein may be applied to the growth of semiconducting charge-transfer complex salts $M^+A^-$ inside via holes with metal M at the bottom, for example in CMOS backend wafers. These materials can be monocrystalline. The metal M can be Cu or Ag. Also other metals can be used. In some embodiments, a wafer with a via is put into contact with a solution as follows:

(a) The solution includes at least one organic solvent containing a nitrile function, a typical representative example being acetonitrile. The solvent system can also be a mixture of two or more organic solvents, at least one of which contains a nitrile function.

(b) The solution contains at least one electron acceptor molecule, which is preferably strongly electron-attractive. The electron acceptor molecule preferably contains at least one nitrile group. Typical representative examples are TCNQ, TCNQ derivatives such as $TCNQF_4$, and $TCNQ(Me)_2$, and TCNQ analogues such as TCNE and DDQ.

(c) The solution contains at least one salt additive, which may be a metallic salt additive represented by the structural formula $M^+Y^-$, where $M^+$ is the same metal cation as in the charge-transfer complex salt $M^+A^-$ and $Y^-$ is a non-reactive counter-ion. For use in Cu wafers, the salt additive can be selected from the group consisting of $Cu(CH_3CN)_4PF_6$, $Cu(CH_3CN)_4BF_4$, $Cu(CH_3CN)_4ClO_4$, $Cu(C_6H_5CN)_4PF_6$, $Cu(C_6H_5CN)_4BF_4$ and $Cu(C_6H_5CN)_4ClO_4$. For use in silver wafers, the salt additive can be selected from the group consisting of $AgBF_4$, $Ag(CH_3CN)_4BF_4$, $AgNO_3$, $AgSO_3CH_3$, $AgSO_3CF_3$, $AgClO_4$, $AgCO_2CH_3$, $AgCO_2CF_3$, $AgSO_3C_6H_4CH_3$, $AgCO_2C_2F_5$ and $AgCO_2C_6H_5$. For other metals M, the salt additive $M^+Y^-$ can be a salt highly soluble in the organic solvent. The salt additive can be $E^+A^-$ for all metals M, with the same acceptor anion $A^-$ as the charge-transfer complex salt $M^+A^-$ and $E^+$ a non-reactive counter-ion. The acceptor anion $A^-$ can be selected from the group consisting of $TCNQ^-$, $TCNQF_4^-$, $TCNQ(Me)_2^-$, $DDQ^-$ and $TCNE^-$; representative examples are $E^+A^-$ type salts, where $E^+$ is $Li^+$, $Na^+$, $K^+$ or a linear or branched alkylammonium group $(C_nH_{2n+1})_4N^+$ (with n=1 to 10) and where $A^-$ can be $TCNQ^-$, $TCNQF_4^-$, $TCNQ(Me)_2^-$, $DDQ^-$ or TCNE.

In order to grow a charge-transfer complex salt $M^+A^-$ on a metal M surface, the metal M surface is contacted with an appropriate solution. This solution comprises at least one organic solvent comprising at least one nitrile function, at least one electron acceptor molecule A as described above and at least one salt additive. The organic solvent may be a single solvent or a mixture of solvents, each comprising one nitrile function. In the following text, the terms nitrile and cyano are both designating the same chemical group. Illustrative examples of nitrile-containing solvents include, but are not limited to, acetonitrile, n-butyronitrile, propionitrile, malononitrile and benzonitrile among others. A function of the nitrile solvent is to dissolve the salt additive. Preferably, the salt additive is highly soluble in the nitrile-containing solvent.

In various embodiments, the solution may comprise one or more co-solvents. For instance, it may comprise one co-solvent. A function of the optional co-solvents is to improve the solubility characteristics of the various components of the solution. For instance, the mixture of the solvent and the co-solvent(s) can enable simultaneously the solubilisation of the salt additive and the precipitation of the $M^+A^-$ charge-transfer complex on the metal M surface. In some embodiments, the solution comprises one or more co-solvents wherein the at least one electron acceptor molecule A is more soluble than the charge transfer complex salt $M^+A^-$. In some embodiments, the co-solvent is such that the acceptor molecule A is more soluble than the charge-transfer complex salt $M^+A^-$. In other embodiments, the co-solvent is selected such that the at least one acceptor molecule A is soluble and the charge-transfer complex salt $M^+A^-$ is not soluble. A desirable property of the co-solvent is relative inertness toward the salt additive. A useful and preferred feature of the co-solvent is the absence of cyano groups. Another useful feature of the at least one co-solvent is the absence of amino groups. An example of co-solvent that can be used in addition to a nitrile-containing solvent is toluene. Other suitable co-solvents comprise, but are not limited to, $C_5$-$C_{10}$ alkanes such as pentane, hexane or heptane, $C_5$-$C_8$ cycloalkanes such as e.g. cyclohexane or methyl cyclohexane, $C_6$-$C_{15}$ aromatics such as e.g. xylene or benzene, $C_5$-$C_{15}$ heteroaromatics such as pyridine, and $C_6$-$C_{15}$ halogenated aromatics such as chlorobenzene. In some embodiments, the volume ratio of the one or more nitrile-containing solvents with respect to the one or more co-solvents can be varied from about 50:50 to 0.1:99.9. For instance the ratio nitrile solvent(s)/co-solvent(s) can be from 40:60 to 1:99, or from 30:70 to 10:90, or from 25:75 to 15:85, e.g. 20:80 (for instance n-butyronitrile/toluene 20:80 by volume).

The salt additive is preferably selected from the group consisting of $M^+Y^-$ and $E^+A^-$, where $Y^-$ and $E^+$ are non-reactive counter-ions and $A^-$ is the anion corresponding to the electron acceptor molecule A. In other words, in one embodiment, the at least one salt additive has the same metal cation as the charge-transfer complex salts, and a non-reactive counter-ion. In this embodiment, the metal M cation $M^+$ is therefore the same metal cation as the metal cation of the charge-transfer complex. In another embodiment, the at least one salt additive comprises the same electron acceptor anion as said charge-transfer complex salt and a non-reactive counter-ion. In this embodiment, the electron acceptor anion $A^-$ is therefore the same electron acceptor anion as the electron acceptor anion of the charge-transfer complex.

For instance, if the charge-transfer complex to be grown on a copper surface is $Cu^+TCNQ^-$, the salt additive may be a $Cu^+$ salt, a $TCNQ^-$ salt or a combination of one or more of such salts.

Preferred metal cations $M^+$ are $Cu^+$ and $Ag^+$.

Examples of salt additives useful in various embodiments are $Cu^+$ salt additives selected from the group consisting of $Cu(CH_3CN)_4PF_6$, $Cu(CH_3CN)_4BF_4$, $Cu(CH_3CN)_4ClO_4$, $Cu(C_6H_5CN)_4PF_6$, $Cu(C_6H_5CN)_4BF_4$ and $Cu(C_6H_5CN)_4ClO_4$. Other examples of salt additives useful in various embodiments are $Ag^+$ salt additives selected from the group consisting of $AgBF_4$, $Ag(CH_3CN)_4BF_4$, $AgNO_3$, $AgSO_3CH_3$, $AgSO_3CF_3$, $AgClO_4$, $AgCO_2CH_3$, $AgCO_2CF_3$, $AgSO_3C_6H_4CH_3$, $AgCO_2C_2F_5$ and $AgCO_2C_6H_5$.

Preferred electron acceptor anions are selected from the group consisting of 7,7,8,8-tetracyanoquinodimethane anion, 2,5-dimethyl-7,7,8,8-tetracyanoquinodimethane anion, 2,3,5,6-tetrafluoro-7,7,8,8-tetracyano-quinodimethane anion, tetracyanoethylene anion and 2,3-dichloro-5,6-dicyano-p-benzoquinone anion.

The at least one salt additive can also be of the general formula $E^+A^-$. In this embodiment, $E^+$ is for instance selected from the group consisting of $Li^+$, $Na^+$, and $K^+$. In this embodiment $A^-$ can suitably be selected from the group consisting of 7,7,8,8-tetracyanoquinodimethane anion, 2,5-dimethyl-7,7,8,8-tetracyano-quinodimethane anion, 2,3,5,6-tetrafluoro-7,7,8,8-tetracyanoquinodimethane anion, tetracyanoethylene anion and 2,3-dichloro-5,6-dicyano-p-benzoquinone anion.

In another embodiment, the at least one salt additive may be a linear or branched alkylammonium salt with the structure $(C_nH_{2n+1})_4N^+A^-$ wherein n=1 to 10 and the anion of the acceptor $A^-$ is selected from the group consisting of 7,7,8,8-tetracyanoquinodimethane anion, 2,5-dimethyl-7,7,8,8-tetracyanoquinodimethane anion, 2,3,5,6-tetrafluoro-7,7,8,8-tetracyanoquinodimethane anion, tetracyanoethylene anion, 2,3-dichloro-5,6-dicyano-p-benzoquinone anion.

The presence of the salt additive favours the precipitation of the charge transfer complex onto the metal M surface. The salt additive is preferably in a concentration such as to increase the product $[M^+][A^-]$ (at the interface metal/solution) to a value higher than the solubility product $K_{sp}$ of said charge-transfer complex salts $M^+A^-$, wherein $[M^+]$ is the concentration of said metal cation $M^+$ in said solution and $[A^-]$ is the concentration of said electron acceptor molecule anion $A^-$.

In one embodiment, the temperature of the solution at the time when the contacting between the metal M surface and the solution is performed is from −100° C. to 100° C. In another embodiment the contacting temperature may be from −100° C. to 30° C., in another embodiment from −100° C. to 0° C., in yet another embodiment from −100° C. to −10° C.

Preferably, the metal M is silver or copper. The methods and solutions described herein are particularly suitable for growing charge-transfer complex salts on a metal area with small dimensions at the bottom of a hole. The hole can be of any size, but the methods and solutions described herein are particularly suitable for growing charge-transfer complex salts in vias, preferably sub-micrometer diameter vias. The depth of the via may for instance be any depth from 50 nm to 1500 nm. The diameter of the via may for instance be any diameter from 32 to 500 nm. The via can for instance be present in a CMOS back end-of-line (CMOS BEOL) wafer or a similar structure. Other examples of substrates wherein methods and solutions described herein are useful for growing charge-transfer complex salt $M^+A^-$ are plastic substrates used in plastic electronics.

The contacting of the metal M surface with the solution can be performed by any way known to the person skilled in the art. For instance the metal surface can be dipped into the solution or the solution can be flowed over the metal surface. In a specific embodiment, the reaction can be performed in a flow cell where different fluids are automatically changed in function of a program. The cell can therefore be flooded successively with one or more cleaning solutions, the solution for growing the charge-transfer complex salts $M^+A^-$, and one or more rinsing solutions.

The growing of the charge transfer complex salt $M^+A^-$ operates at such a speed that the filling in of a sub-micrometer diameter hole can be operated without observing growth of the charge transfer complex salt $M^+A^-$ outside of the via. The time necessary to fill in a sub-micrometer diameter hole can vary greatly in function of various parameters such as the temperature used, the height of the hole, the diameter of the hole, and the chemical nature of the charge transfer complex salt $M^+A^-$. In this respect, the contact time between the metal surface and the solution can vary from about 0.1 second to about 5 minutes, for example from about 1 second to 2 minutes, or from about 5 to 60 seconds.

During the performance of a method according to any embodiment, the mixture can be stirred or not. In any embodiment, the mixture can optionally be submitted to ultrasound for agitation. The reaction can variously be performed at atmospheric pressure, at low vacuum ($10^{-2}$ to below 1 bar), or under pressure (above 1 bar and up to 100 bars). In any embodiment, the reaction can be performed in moist air, in dried air, or under a protective or inert atmosphere (such as nitrogen, argon, helium, carbon dioxide, or a mixture thereof). In any embodiment, the reaction can be performed with a solvent or solvent mixture under supercritical conditions (e.g. at a temperature up to 100° C. and under a pressures up to 100 bars).

The substrate and the solution may be heated or cooled to a particular temperature. This temperature can be in between +100° C. and −100° C., preferably below 0° C., even more preferably between −10° C. and −50° C. Thus a spontaneous chemical reaction of the metal M with the electron-acceptor A is induced, leading to the semi-conducting charge-transfer salt $M^+A^-$.

D. Overview of One Exemplary Embodiment

A particular exemplary embodiment will now be discussed in details for illustrative purposes. In this embodiment, the growth of single crystals of $Cu^+TCNQ^-$ in via-size contact holes onto a Cu BEOL wafer will be discussed. In this particular embodiment, an adequate solution for growing a complex charge transfer salt $Cu^+TCNQ^-$ comprises a nitrile solvent (for example acetonitrile) in which TCNQ and a highly soluble $Cu^+$ or $TCNQ^-$ salt are dissolved, and which has been cooled down below room temperature. These experimental conditions favour growth of $Cu^+TCNQ^-$ in via-size contact holes and limit corrosion of the Cu metal serving for electrical connection to the bottom electrode. Useful steps to achieve this are (i) the addition of a highly soluble $Cu^+$ or $TCNQ^-$ salt to the solution favouring the precipitation of the $Cu^+TCNQ^-$ at the Cu layer at the via's bottom and (ii) the choice of low reaction temperatures decreasing the reaction speed and also favouring $Cu^+TCNQ^-$ precipitation. Usage of a co-solvent can also improve precipitation of $Cu^+TCNQ^-$.

In this particular embodiment, adding a highly soluble salt containing $Cu^+$ cations or $TCNQ^-$ anions favours precipitation of $Cu^+TCNQ^-$ at the Cu metal at the bottom of the via. In fact, when a large concentration of such an ion is achieved, for example by adding $Cu^+$ in form of tetrakis (acetonitrile)copper(I) hexafluorophosphate $Cu(CH_3CN)_4PF_6$, the concentration $[Cu^+_{CH3CN}]$ in the solubility product (eq. 4), becomes the sum of the concentrations in $Cu^+_{CH3CN}$ from the added $Cu^+$ salt and formed by the "spontaneous electrolysis" reaction (eq. 2).

In this particular embodiment, by adding $Cu^+$ salt (for example 50 mg tetrakis(acetonitrile)copper(I) hexafluorophosphate $Cu(CH_3CN)_4PF_6$ in 25 mL acetonitrile corresponding to 5.36 millimol/L of $Cu^+_{CH3CN}$), the product of the concentrations $[Cu^+_{CH3CN}].[TCNQ^-_{CH3CN}]$ becomes higher than $K_{sp}$ for lower values of $[TCNQ^-_{CH3CN}]$ than in absence of added $Cu^+$. As a result $Cu^+TCNQ^-$ crystals precipitates much easier at the Cu metal surface than in absence of the added $Cu^+$ salt. A further advantage of the addition of a highly soluble $Cu^+$ salt is to decrease the concentration gradient of $Cu^+_{CH3CN}$ at the copper metal. Whereas the concentration gradient is high without added $Cu^+$ salt ($Cu^+_{CH3CN}$ is formed at the Cu metal and its concentration in the bulk of the solution is macroscopically zero) it is much lower in presence of added $Cu^+$ salt (by adding for example 5.36 millimol/L the variation at the Cu metal due to the formation of $Cu^+_{CH3CN}$ is negligible). This significant decrease of the concentration gradient reduces diffusion of $Cu^+_{CH3CN}$ into the bulk of the solution and thus reduces also considerably the corrosion of the Cu metal. It is also noteworthy to mention that the added $Cu^+$ salt acts by its presence, and that it is not a reactant which is consumed in the reaction. An analogous principle is valid if a highly soluble salt of the $TCNQ^-$ anion is added instead of the $Cu^+$ cation salt.

In the prior art, most experiments on solution-based $Cu^+TCNQ^-$ growth on blanket substrates were performed at room temperature, and gave rise to polycrystalline rough films with micrometer sized crystals (see e.g. Potember et al, *Appl. Phys. Lett.* (1979) 34:405). Further experiments realized in hot solutions result in smoother polycrystalline films with sub-micrometer particle diameter (see e.g. R. Müller et al, 1st International Conference on Memory Technology and Design (ICMTD), Giens (F), May 21-24 2005, communication EP-2). Whereas extensive corrosion of the copper metal on the bottom of via-size contact holes is already observed by reaction with TCNQ in acetonitrile at room temperature, the effect is even increased at higher temperature. This result can be explained by the effect of the temperature on (i) the kinetics of equation 2, (ii) the diffusion coefficient of the species $Cu^+_{CH3CN}$ and $TCNQ^-_{CH3CN}$, and (iii) the value of the solubility product (eq. 4). In fact, according to chemical kinetics theories (Arrhenius law) reaction speed increases with temperature. In addition, the diffusion coefficients of dissolved species also increase with increasing temperature which signifies that the species $Cu^+_{CH3CN}$ and $TCNQ^-_{CH3CN}$ are diffusing faster away from the copper metal on which $Cu^+TCNQ^-$ crystals should deposit. Furthermore, as it is well known from the recrystallization process of organic compounds and salts, the solubility generally increases with the temperature.

In this particular embodiment, the use of cooled solutions leads to the growth of single crystals of $Cu^+TCNQ^-$ in via-size contact holes of a CMOS Cu BEOL wafer (see below). By cooling down the reaction mixture this kind of growth is favoured since:

(i) the kinetics of equation 2 is reduced, allowing the extent of the growth to be governed by controlling the reaction time, (ii) diffusion of species $Cu^+_{CH3CN}$ and $TCNQ^-_{CH3CN}$ is reduced, leading to lower losses into the bulk of the solution and less corrosion of the Cu metal, and (iii) improved crystal growth is observed because of the lower solubility product and slower precipitation reaction.

By performing solution growth of $Cu^+TCNQ^-$ in acetonitrile in the presence of a highly soluble $Cu^+$ salt and at low temperature, single crystals of this organic charge-transfer material in via-size contact holes of a Cu CMOS BEOL wafer can be grown, in which growth of $Cu^+TCNQ^-$ is even improved by addition of a co-solvent (for example toluene) performing the function of well solubilising TCNQ but not $Cu^+TCNQ^-$.

E. Example

Figure 2:
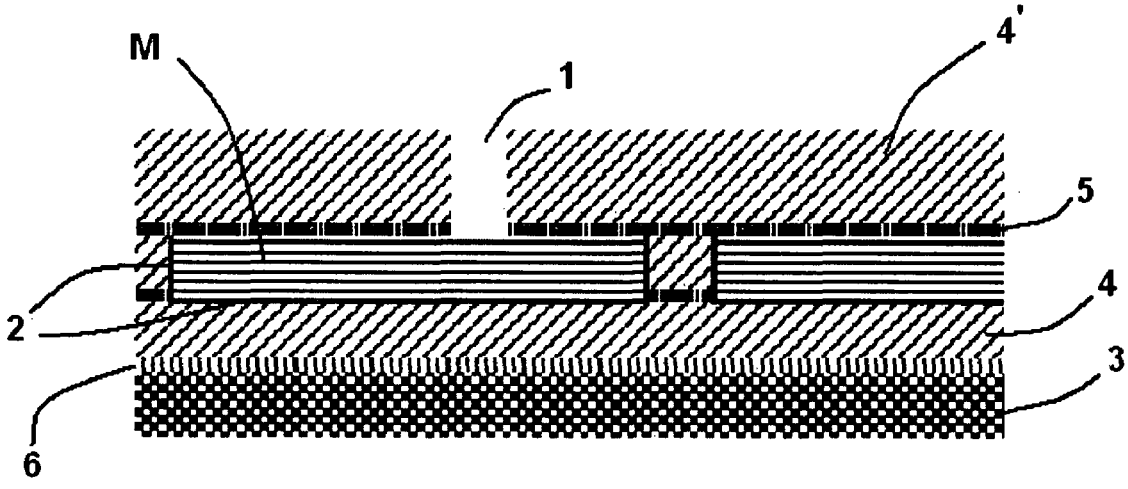
FIG. 2 (Prior Art)
FIG. 2 shows a schematic cross-section of a CMOS back end-of-line wafer with via holes according to the prior art.

The methods described herein were tested on prior art structures according to FIG. 2, with 600 nm copper layer covered by 400 nm $SiO_x$ with etched 250 nm diameter vias exposing a portion of the copper layer. The structures were cleaned successively by ultrasonication in acetone (15 minutes) and isopropanol (15 minutes) before being dried under a nitrogen flow. They were then placed inside a beaker with the via openings upwards and ultra-sonicated for one hour in an acetonitrile/toluene mixture (20:80 volume ratio). The solution for growing CuTCNQ nanocrystals in vias was prepared by dissolving 50 mg 7,7,8,8-tetracyanoquinodimethane TCNQ and 50 mg tetrakis(acetonitrile)copper(I) hexafluorophosphate $Cu(CH_3CN)_4PF_6$ in 25 ml of acetonitrile/toluene (20:80 volume ratio) mixture. This solution, and the beaker with the test structures, were cooled down to −20° C. Then, one by one, each die was quickly taken horizontally out of the beaker with the solvent mixture so that the vias were kept covered by the liquid, and directly put horizontally in the reagent solution for exactly one second, before being taken out, rinsed with acetone, and dried with a nitrogen flow. Scanning electron microscopy (SEM) showed growth of $Cu^+TCNQ^-$ single crystals inside the via.

For longer reaction times (for example 2 to 5 seconds) the material continued to grow along the via axis, trespassing the via border. SEM micrographs taken at this stage showed nice quadratic single crystals on top of the vias, and showed that the Cu interconnect lines were not corroded by the solution used in this method.

F. Detailed Description of the Figures

FIG. 1 is a scheme representing a spontaneous oxidation-reduction reaction between a metal M and an electron acceptor A in solution according to the prior art. FIG. 1 is divided in three zones (11, 12 and M). 11 is the bulk of the solution, 12 is the diffusion layer and M is the metal. The acceptor molecule A goes from the bulk of the solution 11 to the diffusion layer 12 via a mass transfer process 7. The electron acceptor A is reduced via a reduction step 8 by the metal M forming the electron acceptor anion $A^-$. The metal M is thereby oxidised (arrow 9) and forms with the electron acceptor anion $A^-$ the complex charge transfer salt $M^+A^-$ which precipitates via process 10 on the metal M.

FIG. 2 is a schematic cross-section of a CMOS back end-of-line wafer according to the prior art. At the bottom of FIG. 2, a substrate 3 is shown. On top of the substrate 3, an adhesion layer 6 connecting the substrate 3 with an insulator layer 4 is shown. On top of the insulating layer 4, a diffusion barrier 2 is present preventing diffusion of reactive species from or to the metal layer M. The metal layer M is deposited on the diffusion barrier 2. Above the metal layer M, an insulator/adhesion barrier 5 is present on top of which another insulator 4' is deposited. A via hole 1 is formed through the insulator 4' and the insulator/adhesion layer 5 so that the bottom of said via hole is formed by the metal surface M.

Figure 3:
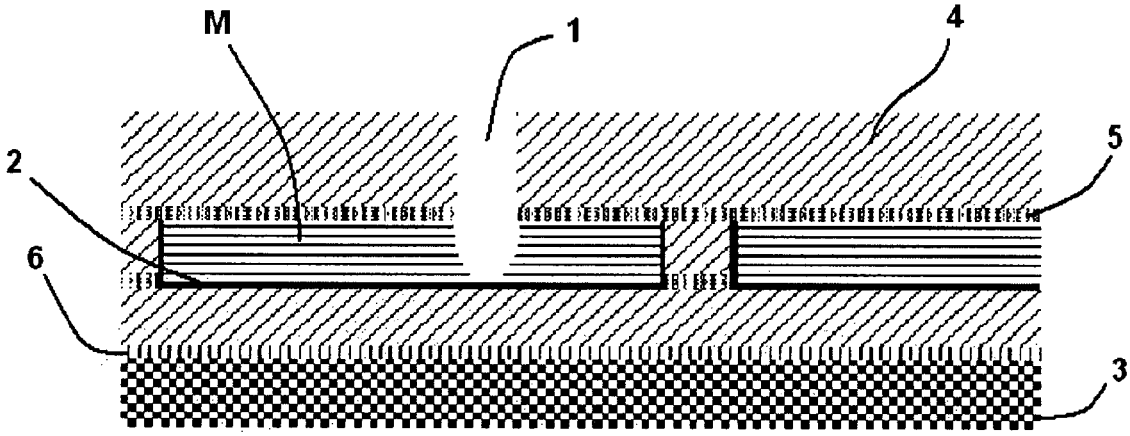
FIG. 3 (Prior Art)
FIG. 3 shows a schematic cross-section of a CMOS back end-of-line wafer showing extensive corrosion of the metal M after reaction with a solution of the acceptor A according to the prior art.

In FIG. 3, the same CMOS back end-of-line wafer as in FIG. 2 is represented after reaction according to the prior art with a solution of an electron acceptor A. Corrosion of the metal M is clearly visible.

Figure 4:
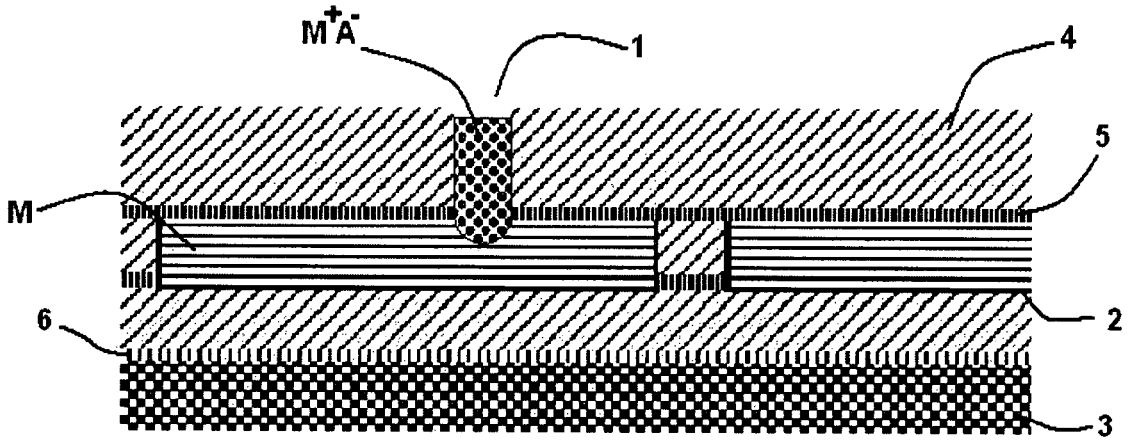
FIG. 4 shows a schematic cross-section of solution grown metal charge-transfer complex $M^+A^-$ in via holes of a CMOS back end-of-line wafer according to the techniques described in the present disclosure.

In FIGS. 4 and 6, a CMOS back end-of-line wafer as in FIG. 2 is represented after reaction with a solution as described herein. The via hole 1 is shown to present only limited corrosion. The complex charge transfer salt $M^+A^-$ is shown filling in the via hole 1. FIG. 6 further depicts the height $H_V$ of the via hole 1, the total metal M thickness $H_M$, the amount $H_c$ by which the metal layer is consumed or corroded, and the remaining metal thickness $H_R$.

Figure 5:
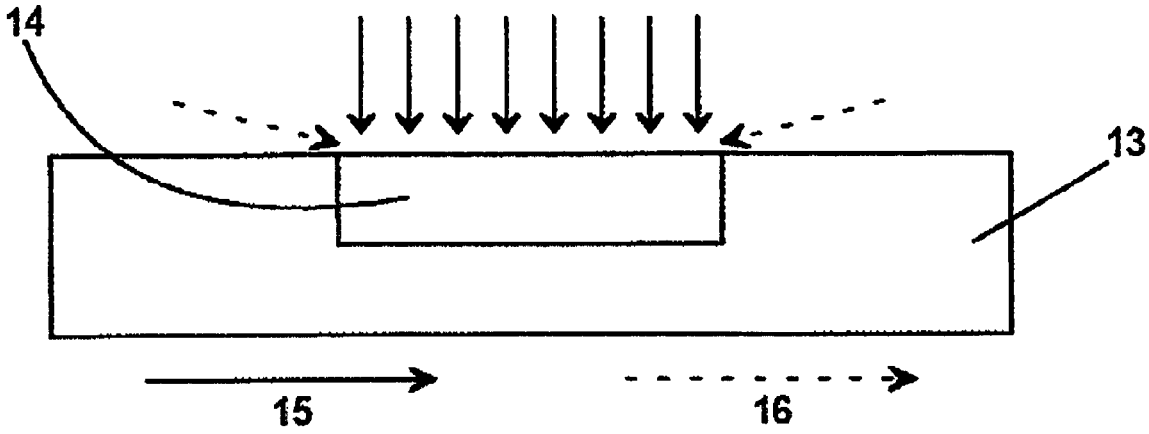
FIG. 5 (Prior Art)
FIG. 5 shows a linear (or planar) and non-linear (or non-planar) diffusion at an electrode.

FIG. 5 schematically presents the two types of TCNQ diffusions that can be observed in an electrochemical cell according to the prior art. An electrode 14 is represented in an insulating substrate 13. For large electrodes 14 and short time scale, linear (planar) diffusion 15 is mainly observed. With the downscaling of the electrode size or for longer time scales, non-linear (non-planar) diffusion 16 gains in importance. In other words, with decreasing electrode dimensions the proportion of non-linear diffusion increases and leads to an increase of the flux according to the prior art.

The invention claimed is:

1. A method for growing a charge-transfer complex salt $M^+A^-$ on the surface of a monovalent metal M, wherein M is either Cu or Ag, said method comprising the step of contacting said metal M surface at a temperature from −100° C. to 100° C. with a solution comprising:

at least one organic solvent comprising at least one nitrile function;

at least one electron acceptor molecule A; and at least one salt additive being independently selected from the group consisting of $M^+Y^-$ or $E^+A^-$, wherein $Y^-$ and $E^+$ are non-reactive counterions, $A^-$ is the anion corresponding to said acceptor molecule A and $M^+$ is the cation corresponding to the metal M;

wherein said contacting of said metal surface with said solution induces a spontaneous chemical reaction leading to growth of the charge-transfer complex salt $M^+A^-$.

2. A method according to claim 1, wherein said metal M surface is at the bottom of a via hole in a substrate.

3. A method according to claim 1, wherein said temperature is from −100° C. to +30° C.

4. A method according to claim 1, wherein said contacting step is performed during a time period of 0.1 second to 5 minutes.

5. A method for growing a charge-transfer complex salt $M^+A^-$ on the surface of a monovalent metal M, wherein M is either Cu or Ag, and wherein the method includes contacting the surface of the monovalent metal M with a solution comprising:

at least one organic solvent comprising one nitrile function;

at least one electron acceptor molecule A;

at least one co-solvent wherein said at least one electron acceptor molecule A is more soluble than said charge-transfer complex salt $M^+A^-$; and at least one salt additive being independently selected from the group consisting of $M^+Y^-$ and $E^+A^-$ wherein $Y^-$ and $E^+$ are non-reactive counter-ions, $A^-$ is the anion corresponding to said acceptor molecule A and $M^+$ is the cation corresponding to the metal M;

wherein said contacting of said metal surface with said solution induces a spontaneous chemical reaction leading to growth of the charge-transfer complex salt $M^+A^-$.

6. A method according to claim 5, wherein:

the electron acceptor molecule A is 7,7,8,8-tetracyanoquinodimethane;

7,7,8,8-tetracyanoquinodimethane is soluble in the co-solvent, and $Cu^{+}TCNQ^{-}$ is not soluble in the co-solvent; and the salt additive is selected from the group consisting of $Cu^{+}Y^{-}$ and $E^{+}TCNQ^{-}$, wherein $Y^{-}$ and $E^{+}$ are non-reactive counter-ions.

* * * * *